United States Patent [19]

Long et al.

[11] 4,211,055

[45] Jul. 8, 1980

[54] MACHINE FOR FEEDING, CUTTING, SPACING AND ACCUMULATING ARTICLES

[75] Inventors: Marshall Long, Man-O-War Cay, The Bahamas; Lewis F. Alley, Kansas City, Mo.; James E. White, Overland Park, Kans.

[73] Assignee: Marlen Research Corporation, Overland Park, Kans.

[21] Appl. No.: 938,038

[22] Filed: Aug. 30, 1978

[51] Int. Cl.[2] ..... B65B 35/24

[52] U.S. Cl. ..... 53/517; 53/531; 53/252; 53/253; 83/107; 198/448; 198/612

[58] Field of Search ..... 53/513, 514, 515, 517, 53/522, 531, 542, 252, 236, 251, 253; 83/107, 105; 198/433, 448, 612

[56] References Cited

U.S. PATENT DOCUMENTS

| | | | |
|---|---|---|---|
| 2,828,595 | 4/1958 | Talbot et al. | 53/251 |
| 2,864,216 | 12/1958 | Long et al. | 53/252 X |
| 3,286,809 | 11/1966 | Meinecke | 198/452 X |
| 3,366,220 | 1/1968 | Hebel | 198/448 |
| 3,601,242 | 8/1971 | Reinemuth et al. | 198/612 X |
| 3,613,863 | 10/1971 | Hedrick et al. | 198/448 X |

*Primary Examiner*—Travis S. McGehee

*Attorney, Agent, or Firm*—Schmidt, Johnson, Hovey & Williams

[57] ABSTRACT

Sausages or other articles having initial lengths several times longer than their final, packaged lengths are automatically severed to their proper dimensions, accumulated into multisausage clusters and then inserted into awaiting containers, all automatically. Each long initial length of material is initially severed into separate lengths, then gathered into side-by-side relationship with other severed lengths, then severed a second time into the final length. The final lengths are then arranged into generally cylindrically configured clusters for axial packing into the awaiting containers. Special handling techniques are used throughout the process so as to render the system fully automated without damaging the materials or failing to pack the prescribed number of materials into each container.

22 Claims, 32 Drawing Figures

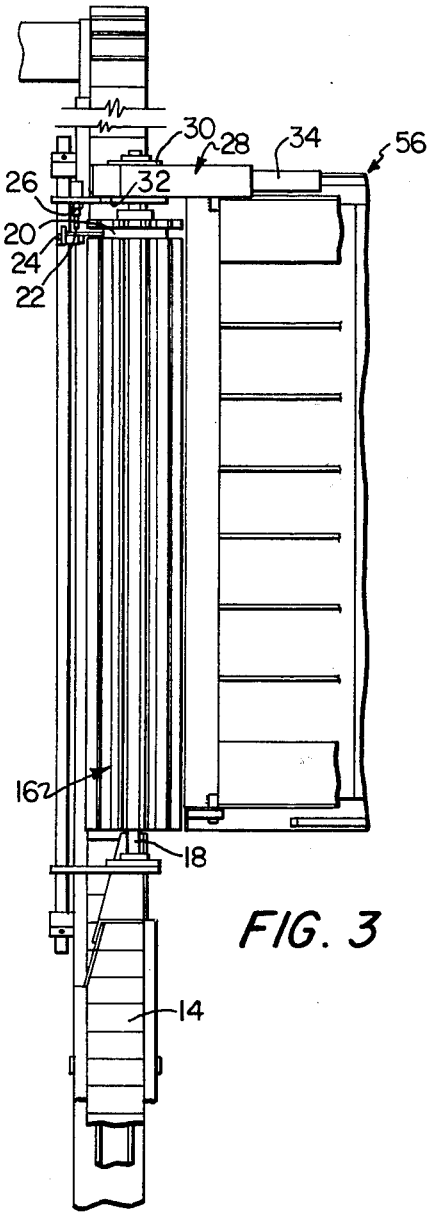
FIG. 3
FIG. 5
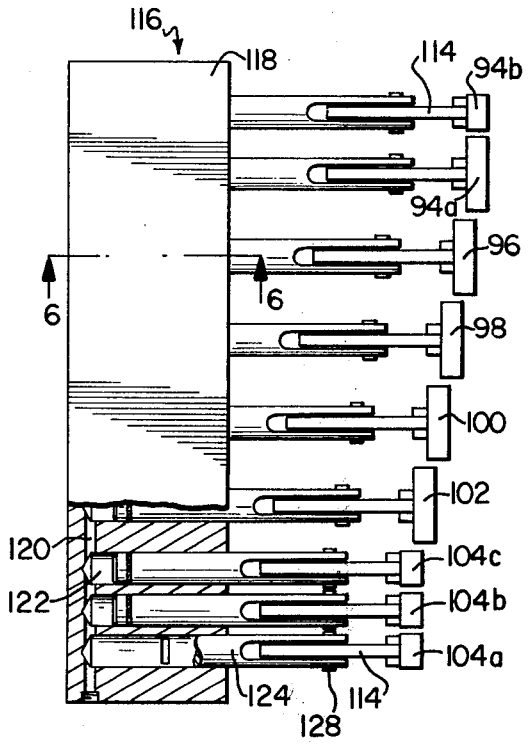
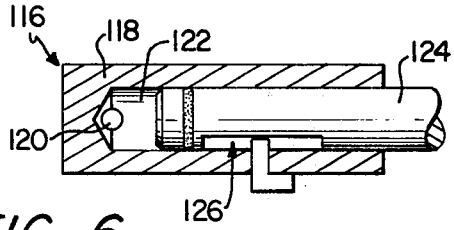
FIG. 6
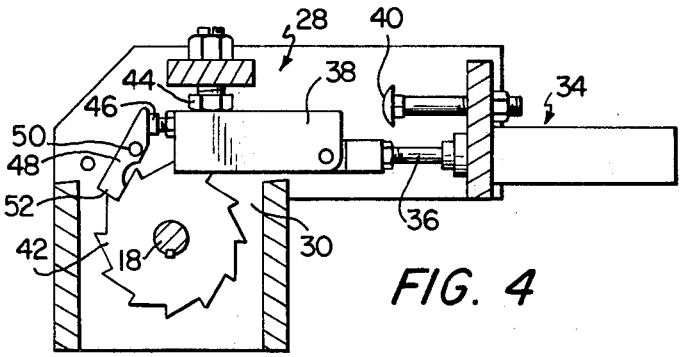
FIG. 4

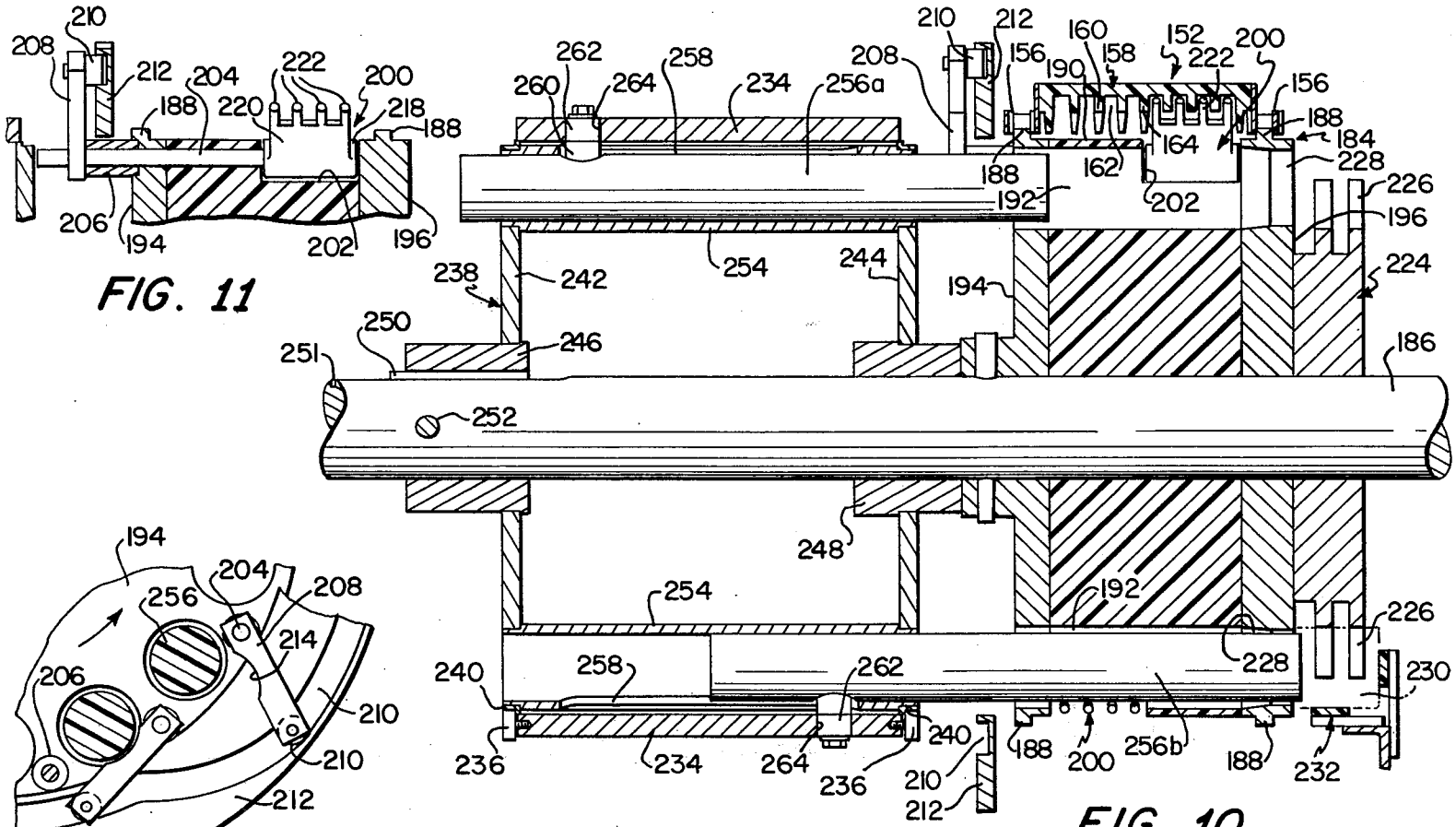
FIG. 10
FIG. 11
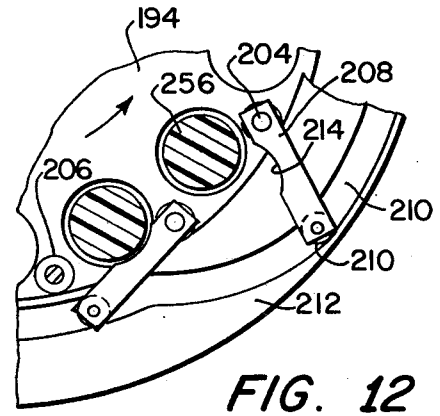
FIG. 12

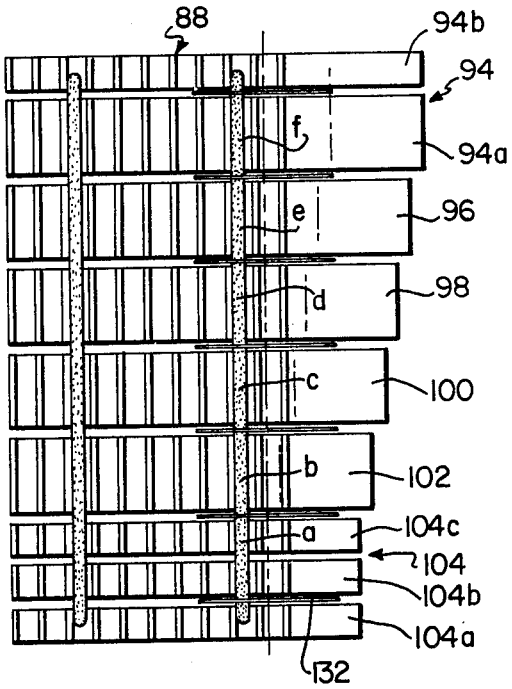
FIG. 23
FIG. 24
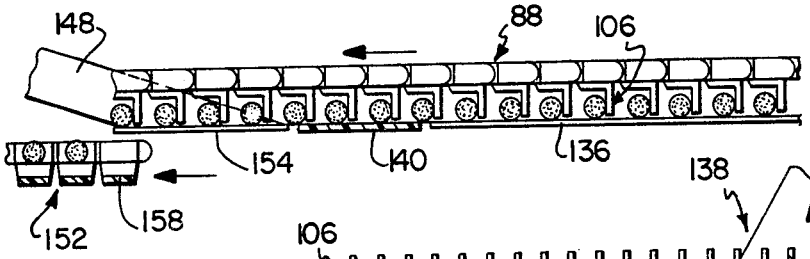
FIG. 25
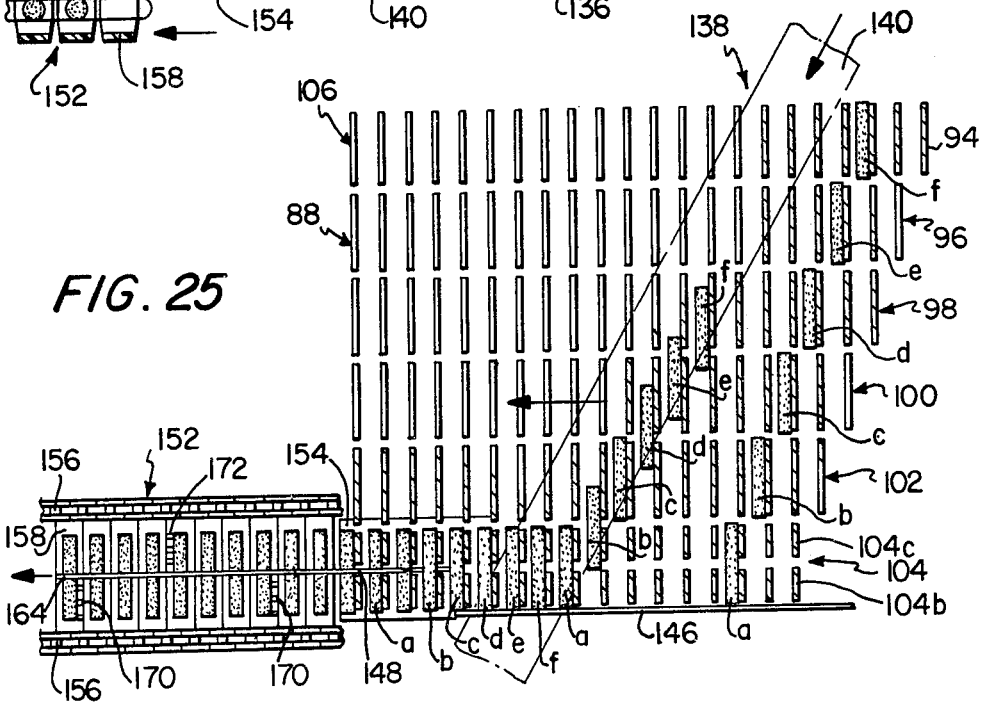

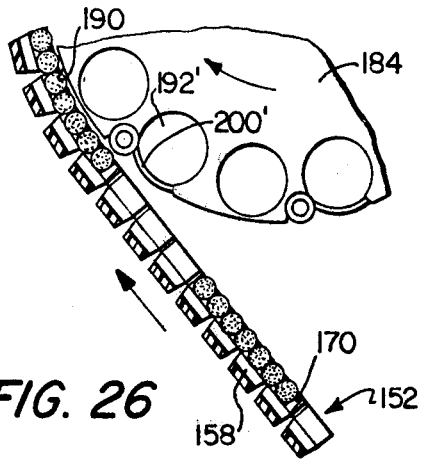
FIG. 26
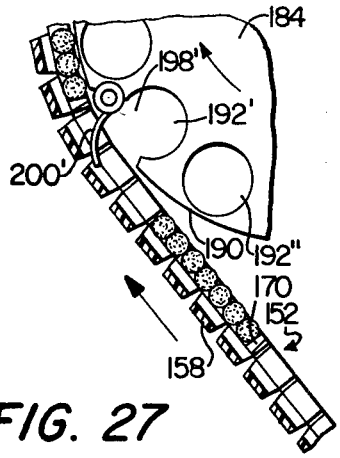
FIG. 27
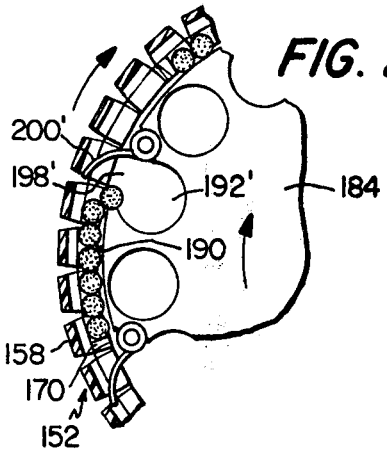
FIG. 28
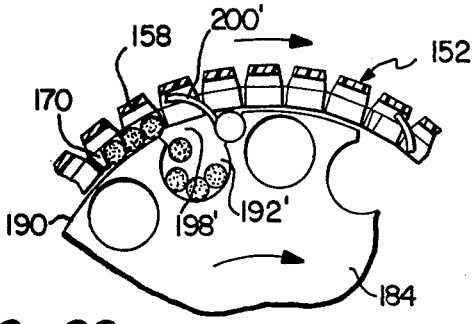
FIG. 29
FIG. 30
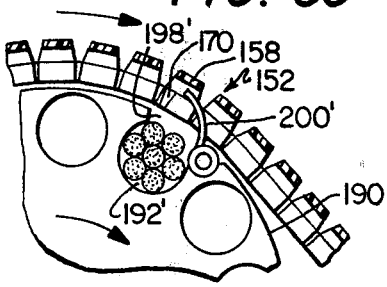
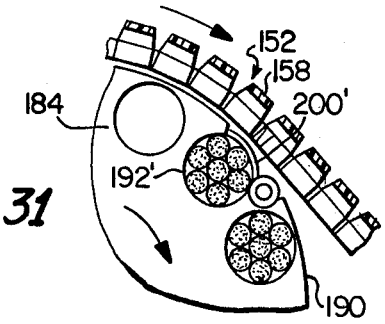
FIG. 31
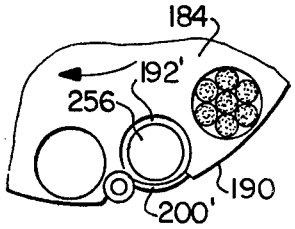
FIG. 32

MACHINE FOR FEEDING, CUTTING, SPACING AND ACCUMULATING ARTICLES

TECHNICAL FIELD

This invention relates to article handling equipment and has special utility in the food processing industry, particularly in the preparation and packing of cylindrical objects such as Vienna Sausages into cans.

BACKGROUND ART

This invention comprises an improvement over the principles described and claimed in prior U.S. Pat. No. 2,864,216 in the name of Long et al and assigned to the assignee of the present invention. While the machine set forth in U.S. Pat. No. 2,864,216 has proven to be remarkably troublefree and fully capable of carrying out its intended function, nonetheless, it is not entirely automated and requires several operators to bunch the long initial lengths of sausages together and properly load such bunches into the machine for subsequent processing thereby. Moreover, by using manual labor in this way, the prior operation was subject to certain inaccuracies in ultimate sausage lengths and excesses in trimmed waste as a result of the inherent degree of imprecision which accompanies manual involvement in processing operations.

SUMMARY OF THE INVENTION

Accordingly, it is a primary object of the present invention to provide a fully automated alternative to the partially manual packing operation as embodied in prior U.S. Pat. No. 2,864,216 so as to receive and enjoy all of the many benefits flowing from such a fully mechanized operation including, for example, decreased labor expenses, minimized product wastage, precision control and optimum performance.

In achieving the foregoing, there are a number of significant areas of design and operation which demand attention. These will ultimately be set forth in the claims which follow the detailed description of the invention, but for the timebeing, a brief summary of the operation will suffice. It should be pointed out also that although the present invention will hereinafter be described in connection with sausages and the procedure necessary to pack the same into cans, the principles set forth herein and claimed hereinafter may be applied to many different types of materials and articles.

Initially, long lengths of sausages, hereafter referred to as "pencils", are deposited intermittently upon a conveyor for movement in a direction of travel transversely of the long pencils. The pencils are spaced apart laterally as they move along the conveyor, and near the leading end of the conveyor, each pencil is severed into a number of end-to-end, aligned segments by a bank of cutters. As such end-to-end segments then move around said leading end of the conveyor, they are displaced laterally out of their end-to-end alignment by virtue of the fact that the conveyor comprises a number of separate, parallel-running sections that are of progressively increasing lengths as the conveyor is traversed from one side to the opposite side thereof. The ends of the sections are thus staggered relative to one another across the leading end of the conveyor so that it takes longer for certain of the segments to move around the end of the conveyor than others, thus resulting in their displaced relationship.

Although the segments have been displaced into a diagonal pattern after moving around the staggered end of the conveyor, they remain on their respective conveyor sections until gathered all to one side of the conveyor by a special obliquely disposed gathering conveyor, whereupon the segments are all disposed in side-by-side relationship in a line running parallel to the path of travel of the main conveyor.

If desired, the segments at this point may be subdivided into two or more parts so as to further reduce their lengths. There, thus, is presented at that point in time two separate lines of short sausages running parallel to the path of travel of the main conveyor.

Thereupon, the shortened sausages are loaded upon a third conveyor which is capable of handling both lines of sausages, but which also causes them to become arranged in multiple sausage groups. Each group is longitudinally offset from the other with respect to the path of travel of the third conveyor which, upon receiving the sausages, travels to a cluster-forming turret in which each group of the sausages is formed into a cluster prior to packing into an awaiting container. The third conveyor is looped around the cluster-forming turret which rotates at a certain speed slightly slower than the linear speed of the third conveyor and is provided with a circumferentially spaced series of chambers, each of which is designed to contain one cluster of the sausages.

The groups of sausages are trapped between the periphery of the rotating turret and the loop of the conveyor, and because of the relative differential in speed between the periphery of the turret and the conveyor, the sausages are progressively advanced along the periphery of the turret and successively into an awaiting inlet of a chamber aligned with that portion of the conveyor. Because the two lines of sausage groups handled by the conveyor are offset linearly relative to one another, and because also the inlets to the successive chambers along the periphery of the turret are likewise offset and spaced axially of one another relative to the axis of rotation of the turret, the two lines of sausage groups are simultaneously loaded into different ones of the chambers.

Containers are brought into alignment with the chambers at certain points in the revolution of the turret, whereupon rams associated with the chambers are operated to eject the individual clusters of sausages into the corresponding, aligned containers.

BRIEF DESCRIPTION OF THE DRAWINGS

FIG. 3 is a fragmentary, enlarged, top plan view of the initial feeding portion of the machine;

FIG. 4 is a fragmentary, enlarged, detailed view of certain operating components of said feeder shown in FIG. 3;

FIG. 5 is a fragmentary, detailed view, with parts broken away and shown in cross section, of the staggered end of the main conveyor showing the way in which the various conveyor sections thereof are maintained in staggered relationship to one another;

FIG. 6 is a fragmentary, enlarged, cross-sectional view of the manifold associated with the structure of FIG. 5 and taken along line 6—6 thereof;

FIG. 10 is an enlarged, fragmentary, cross-sectional view of the apparatus taken substantially along line 10—10 of FIG. 8;

FIG. 11 is a fragmentary, cross-sectional view of the gate associated with the inlet for each cluster-forming chamber and the associated operating mechanism therefor, said view being taken along line 11—11 of FIG. 8;

FIG. 12 is an enlarged, fragmentary end view of the gate operating mechanism of FIG. 11 and illustrating its manner of operation;

FIGS. 16–23 are essentially schematic sequential views of the initial feeder, main conveyor and cutter associated therewith showing sequential steps in the initial phase of the operation;

FIGS. 24 and 25 are schematic views of the lower stretch of the main conveyor and associated structures showing the way in which the sausages are gathered to one side of the conveyor and are loaded onto the third conveyor for transport to the cluster-forming turret; and FIGS. 26–32 are fragmentary, schematic views of the cluster-forming turret and associated structures illustrating sequential steps in the operation thereof.

DETAILED DESCRIPTION

Figure 1:
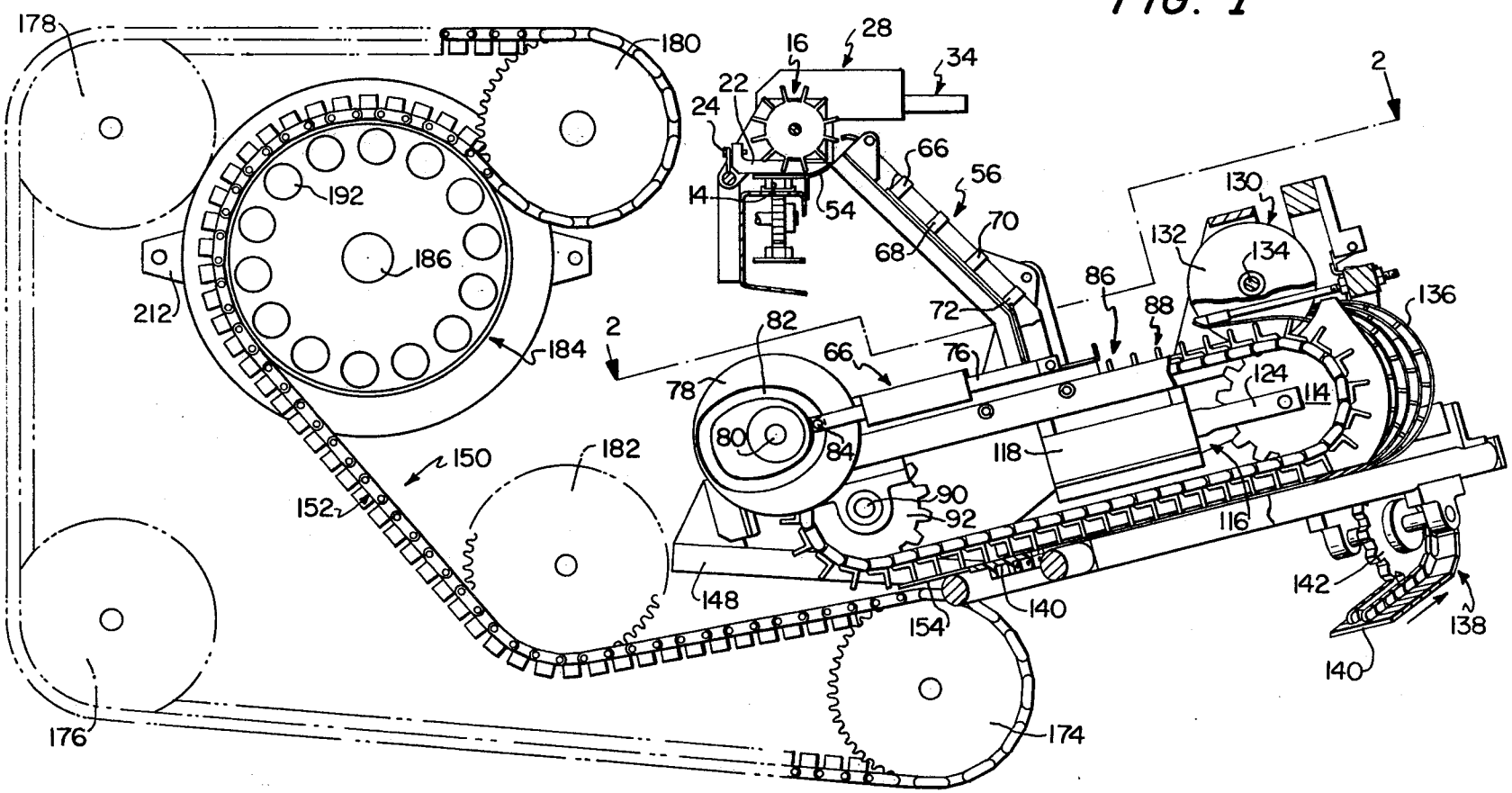
FIG. 1 is a somewhat schematic view of a machine constructed in accordance with the principles of the present invention, various mounting and support structure being removed to reveal details of construction and certain parts shown partially in cross section and in elevation for clarity.
Figure 15:
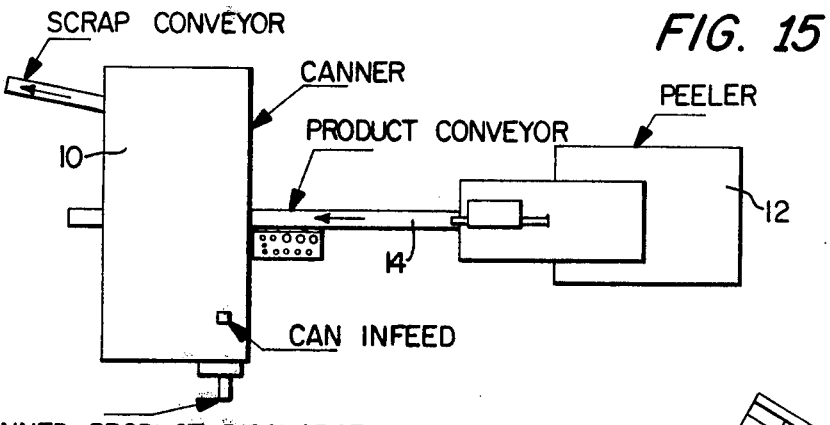
FIG. 15 is a top plan view on a reduced scale of a typical installation utilizing the machine of the present invention.

With initial reference to FIG. 15, it is contemplated that the machine 10 of the present invention will be connected downstream from a peeler 12 which is operable to remove the casings from the sausage pencils after the same have been cooked and/or smoked. The pencils are placed upon a conveyor 14 in end-to-end, single file order, where they are delivered to the machine 10. Referring now to FIG. 1, it will be noted that this is a view of the machine taken across the conveyor 14 and looking leftwardly into the machine 10 as viewed in FIG. 15.

The pencil conveyor 14 passes beneath a fluted indexing cylinder 16 (see also FIG. 3) supported by a shaft 18 for rotation about an axis parallel to the path of travel of the pencil conveyor 14. The indexing cylinder 16 has a circumferentially extending gap 20 at the distal end thereof providing clearance for a transversely extending sensing arm 22 disposed across the path of travel of the incoming sausage pencils and swingable about a transversely disposed pivot 24. The arm 22 is normally spaced from the actuating end of a microswitch 26 as illustrated in FIG. 3 but, when depressed by an incoming pencil, is operable to actuate said switch 26 which in turn closes an electric circuit to cause momentary actuation of a drive assembly 28 for the indexing cylinder 16.

The drive assembly 28 is located beyond the distal end of the cylinder 16 between upright plates 30 and 32 as illustrated in FIGS. 3 and 4 and includes as a primary component an air cylinder 34. The ram 36 of air cylinder 34 is pivotally connected to a dog 38 of generally rectangular configuration at the lower rear end of the dog 38, thus permitting the dog 38 to pivot between the horizontal postion shown in FIG. 4 and a slightly downwardly inclined position (not shown). A rounded cam 40 is spaced rearwardly from the dog 38 but at the same elevation as the upper rear corner of the latter when the ram 36 is fully extended as in FIG. 4.

The lower front corner of the dog 38 is disposed for driving engagement with a circumferentially toothed ratchet wheel 42 keyed to the shaft 18 of the indexing cylinder 16. An adjustable locking screw 44 holds the dog 38 down into engagement with the ratch wheel 42 when the ram 36 is fully extended as in FIG. 4, and a pad 46 projecting from the forwardmost end of the dog 38 is disposed for operating engagement with an antiretrograde lever 48 mounted intermediate its ends by a pivot 50, the normally lower end 52 of lever 48 being disposed for engagement behind a selected tooth of the wheel 42 in order to prevent clockwise, retrograde rotation of the wheel 42.

When the ram 36 is retracted upon depression of the sensing arm 22 and triggering of the microswitch 26, the front end of the dog 38 is cammed downwardly in a counterclockwise direction viewing FIG. 4 by the cam 40 engaging the upper rear corner thereof, thus placing the lower front corner of the dog 38 behind the next, clockwise-disposed tooth of the ratchet wheel 42. Subsequent extension of the ram 36 causes the dog 38 to advance the ratchet wheel 42 one increment counterclockwise as the pad 46 then reestablishes contact with the lever 48 and positively forces the lower end 52 thereof down into position behind a tooth of the wheel 42.

Figure 13:
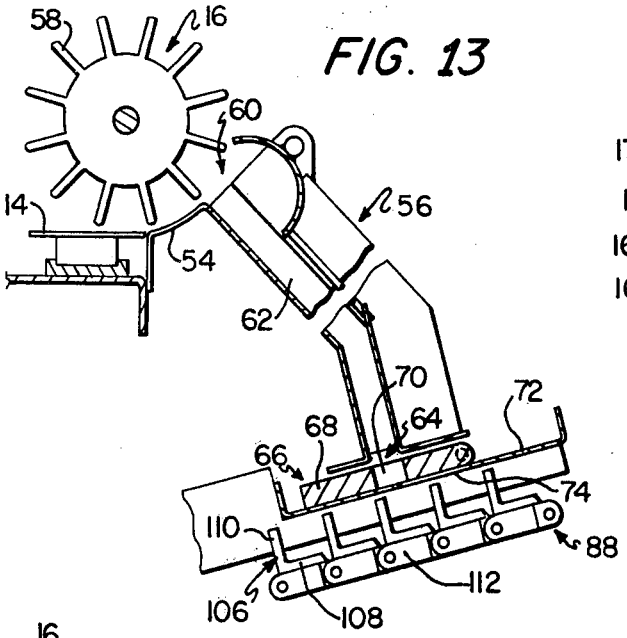
FIG. 13 is a fragmentary, elevational view, partially in cross section and somewhat schematic for clarity, of the feeder which supplies long sausage pencils to the main conveyor of the machine.

As illustrated perhaps best in FIGS. 1 and 13, an arcuate shelf 54 is disposed rightwardly adjacent of that portion of the pencil conveyor 14 which underlies the indexing cylinder 16, the shelf 54 extending the full length of the indexing cylinder 16 which, preferably, corresponds in length with the incoming sausage pencils. The shelf 54, as a result of its arcuate configuration, is slightly dished along the upper surface thereof in substantially concentric relationship to the shaft 18 of indexing cylinder 16.

The shelf 54 thus bridges the gap between the pencil conveyor 14 and a downwardly inclined magazine 56. The shelf 54 corresponds in width to the distance between an adjacent pair of flutes 58 of the indexing cylinders 16 and, likewise, the mouth 60 of the magazine 56 at the upper end thereof is of a width substantially corresponding to the distance between adjacent flutes 58.

The magazine 56 extends the full length of the shelf 54 and slightly beyond the distal end of the indexing cylinder 16 and presents a largely rectangular passage 62 leading between the mouth 60 and the lower discharge exit 64 thereof. The thickness of the passage 62 is such as to confine the sausage pencils to a single file stack thereof with their longitudinal axes extending transversely of their downward path of movement by gravity through the passage 62.

As illustrated in FIG. 1, four sensors 66, 68, 70 and 72 respectively are spaced along the magazine 56 from top to bottom thereof for the purpose of controlling various functions associated with the operation of the machine 10. Thus, the sensor 66 is operable to stop the peeler 12 if the magazine 56 is too full of sausage pencils; the sensor 68 is operable to slow down the peeler 12 when needed; the sensor 70 is operable to speed up the peeler 12 when needed; and the sensor 72 is operable to stop the operation of the remainder of the machine 10 yet to be described in the event that no sausage pencils appear at the sensor 72.

Figure 21:
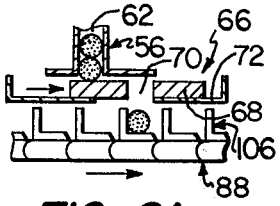

An escapement assembly 66 at the lower end of the magazine 56 controls the discharge of sausage pencils from the exit 64. The assembly 66 includes a plate 68 extending the full width of the magazine 56 and having a slot 70 corresponding dimensionally with the discharge exit 64. The plate 68 is slideable upon a deck 72 between a rearward position as illustrated in FIG. 13 in which the slot 70 is vertically aligned with the discharge exit 64 and a forward position as illustrated in FIG. 21 in which the slot 70 registers with a larger opening 74 in the underlying deck 72.

The assembly 66 further includes a pair of connecting rods 76 (FIGS. 1 and 2) coupled with the plate 68 at opposite ends thereof and extending rearwardly therefrom to a pair of respective cams 78. Each of the cams 78 is carried for rotation by a power input shaft 80, and each also has a generally elliptically-shaped cam track 82 about the axis of rotation of the shaft 80 within which a follower 84 on the rearmost end of the connecting rods 76 is received. Consequently, rotation of the power input shaft 80 causes reciprocation of the connecting rods 76 to in turn reciprocate the plate 68 between its abovementioned alternate positions.

The various structures thus far described may be collectively referred to as a feeder for the gathering and arranging mechanism 86 now to be described. The mechanism 86 broadly includes a main conveyor 88 situated below the magazine 56 and in position to intermittently receive sausage pencils therefrom and from the escapement assembly 66. A drive shaft 90 for the conveyor 88 extends across the rear end of the latter below the input shaft 80 and is operably connected with the latter via a gear train not illustrated. A series of guide sprockets 92 (only one being shown in FIG. 1) are fixed to the drive shaft 90 along the length of the latter for use in guiding six separate sections 94, 96, 98, 100, 102 and 104 of conveyor 88 during operation of the latter. The section 94 consists of a pair of subsections **94*a* and 94*b*, and there is provided a sprocket 92 for each of said subsections. Similarly, on the opposite lateral side of the conveyor 88, the section 104 is divided into three subsections 104*a*, 104*b* and 104*c***.

The four middle sections 96, 98, 100 and 102 are all equal in width to one another and to the subsection **94*a* and the combined widths of the subsections 104*b* and 104*c*. Sections 94 and 104 as a whole, however, are wider than middle sections 96, 98, 100 and 102 because the outboard subsections 94*b* and 104*a* are added to carry the opposite tip ends of pencils deposited upon the conveyor 88 as illustrated, for example, in FIG. 23**, such opposite tip ends eventually being diverted away from the other, equal length sausage segments as will hereinafter appear.

Figure 2:
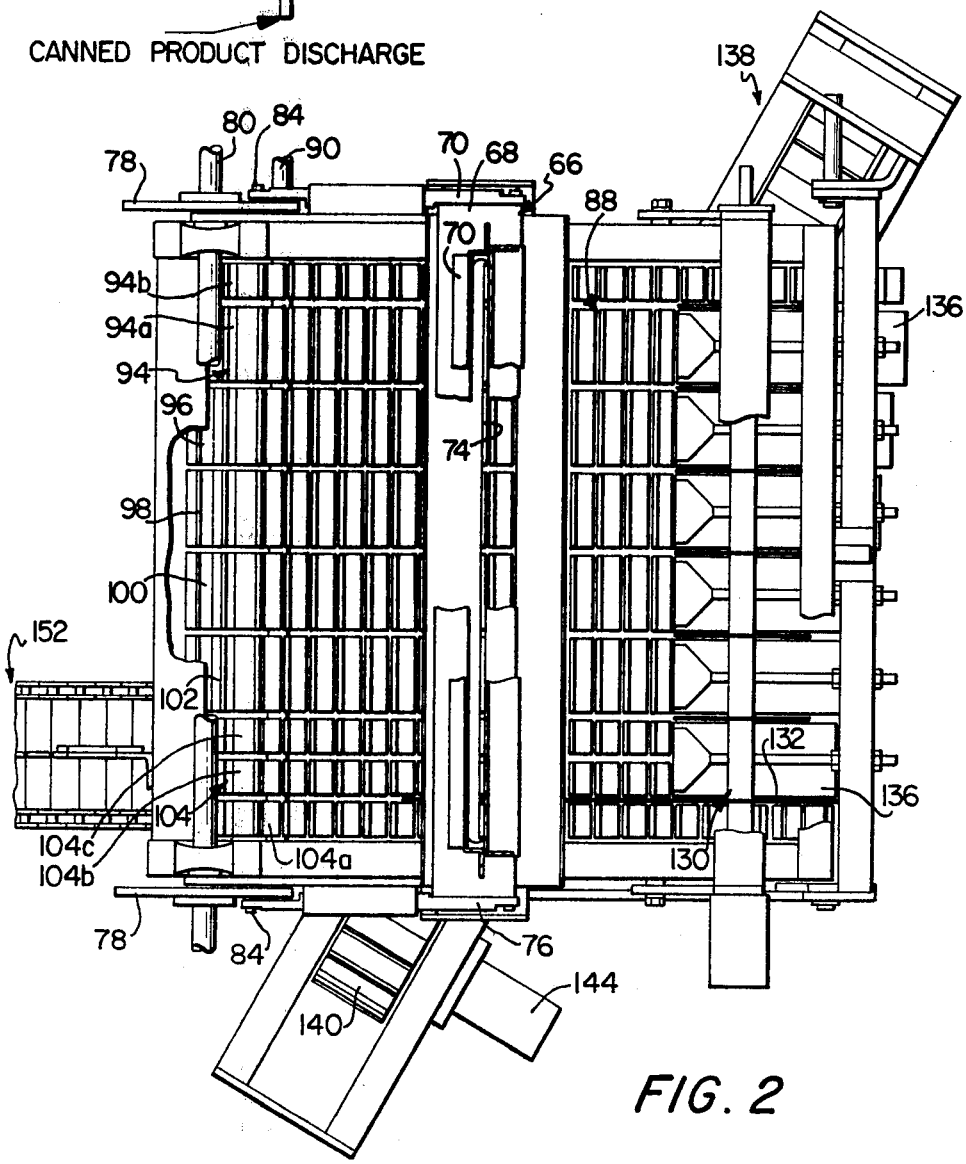
FIG. 2 is a fragmentary, cross-sectional view of a portion of the machine taken substantially along line 2—2 of FIG. 1.

The sections 94–104 extend in parallel relationship to one another and are each provided with generally L-shaped, transversely disposed carriers 106 attached in a series along the lengths thereof. As illustrated in the enlarged view of FIG. 13, each of the carriers 106 has a generally planar base 108 lying in a plane that parallels the path of travel of the conveyor 88 and an outwardly projecting backstop 110 disposed at the trailing edge of the base 108. Each of the sections 94–104 otherwise includes a link chain 112 to which the carriers 106 are attached, there being one carrier 106 on each link. As illustrated in FIG. 2, the carriers 106 associated with the outermost subsections **94*b* and 104*a* are narrower than the corresponding carriers 106 associated with the subsection 94*a* and the sections 96, 98, 100 and 102. The carriers 106 associated with the subsections 104*b* and 104*c* correspond dimensionally with the carriers 106 of the subsections 104*a* and 94*b***.

The distance between the backstops 110 of adjacent, fore-and-aft disposed carriers 106 is such that the backstops 110 will permit the reception of a sausage pencil therebetween, the backstops 110 thereupon serving to contain the sausage pencils and to assist in advancement thereof in a direction transverse to the longitudinal axis of the pencils.

The end of the conveyor 88 opposite the drive shaft 90 thereof is staggered. Likewise, the section 102 includes one extra chain link and carrier 106 than the section 104; the section 100 includes two more chain links and two more carriers 106 than the section 104 and so forth until the section 94 is considered which has five more chain links and carriers 106 than the section 104. Thus, the sections 94–104 progressively increase in length by the amount of one carrier 106 each as the conveyor 88 is traversed from the section 104 to the section 94. Guide sprockets 114 are provided for each of the sections and subsections of the conveyor 88, and such sprockets 114 are held in proper staggered disposition to one another corresponding to the desired staggered condition of the end of the conveyor 88.

A special tensioning assembly 116 (FIGS. 1, 5 and 6) for positioning the guide sprockets 114 includes a manifold 118 having a longitudinal air passage 120 extending transversely of the elongated conveyor 88. As shown clearly in FIG. 1, the manifold 118 is located between the upper and lower stretches of the conveyor 88 in position to avoid interference with either of the same.

Nine bores 122 or cylinders intersect the passage 120 and extend at right angles therefrom to the exterior of the manifold 118, each of the bores 122 reciprocably receiving a ram 124 held against rotation within the bore 122 by a key and slot arrangement 126 as illustrated in FIG. 6. The outermost ends of the rams 124 are bifurcated and provided with transversely extending pins 128 for rotatably supporting respective ones of the guide sprockets 114. All three rams 124 associated with the section 104 are of equal length, while the remaining rams 124 associated with the sections 102, 100, 98, 96 and 94 all increase in length by the amount of one-half the width of a carrier 106, the two rams 124 associated with the section 94 being of equal length. Inasmuch as the bores 122 are intercommunicated by the common air passage 120, the rams 124 are all subjected to the same air pressure so as to be extended from their respective bores 122 by amounts which differ only because of their varying lengths.

Overlying the staggered end of the conveyor 88 and spanning the latter is a bank of cutters 130 comprising a series of seven individual cutting discs 132 secured to a shaft 134. The shaft 134 is disposed in perpendicular relationship to the path of travel of the conveyor 88, and the discs 132 are so positioned that their lowermost peripheries extend down into the spaces between adjacent ones of the conveyor sections 94–104 and the subsections associated therewith, all as shown in FIG. 23. Note that no cutting disc 132 is provided for the space between the subsections **104*b* and 104*c* of the section 104. The shaft 134 is driven by means not shown. Each of the sections 94–104 is provided with a flexible wrapper strip 136 (FIGS. 1 and 2) looped around the same at the staggered end of the conveyor 88, such strips 136 being spaced outwardly from the surfaces of their respective conveyor sections by a distance corresponding to the height of the backstops 110 of the carriers 106 so as to effectively form a cover for the carriers 106 around that portion of the conveyor 88. Note that no such strips 136 are provided around the subsections 94*b* and 104*a*** for reasons which will ultimately become apparent.

The wrapper strips 136 continue around their respective conveyor sections and terminate along the bottom of the conveyor 88 in an oblique line that parallels and is disposed immediately alongside of an obliquely disposed gathering conveyor device 138 as illustrated perhaps best in FIGS. 2 and 25. Thus, the covers for the carriers 106 formed by the wrapper strips 136 terminate along and on the upstream side of the oblique conveyor 138, such relationship also being shown in FIG. 24. At the point of termination of the wrappers 136, the conveyor 138 becomes the underlying cover for the carriers 106.

As illustrated in FIGS. 1, 2, 24 and 25, the oblique conveyor 138 includes a belt 140 of segmented nature and has an upper surface disposed immediately below the outermost tips of the backstops 110 of the carriers 106. The belt 140 is guided at its opposite ends by a pair of sprockets 142 (only one being shown) which are themselves disposed in oblique relationship to the path of travel of the conveyor 88. A motor 144 connected with the obscured sprocket 142 is operable to drive the upper surface of belt 140 at such a speed that the velocity component of the belt 140 in the direction of movement of the lower stretch of the conveyor 88 is equal to the speed of said lower conveyor stretch 88. Hence, although any given point along the top stretch of the belt 140 moves laterally relative to the conveyor 88 toward the section 104, there is no relative movement between such point and the conveyor 88 with respect to its path of travel. A barrier 146 extends along the outboard side of the conveyor 88 as shown in FIG. 25 next adjacent to the section 104 and has a vertical dimension at least as great as the corresponding dimension of the carriers 106.

If desired, and although preferred, it is not essential, there may be provided a knife blade 148 as shown in FIGS. 1, 24 and 25 having a lower cutting edge which projects down into the space between subsections **104*a* and 104*b* of conveyor section 104 along the lower stretch thereof just beyond the oblique conveyor 138. This knife blade 148 has the function of further subdividing the various sausage segments if such is desired and, preferably, the cutting edge of the knife blade 148** is sufficiently beveled as to provide a spacing function upon severance as will hereinafter appear.

Apparatus denoted by the numeral 150 is disposed leftwardly of the mechanism 86 as viewed in FIG. 1 and includes transfer structure in the nature of a conveyor element 152 which underlies the conveyor section 104 at a position immediately downstream from a floor 154. The floor 154 is located beneath that portion of the conveyor section 104 which is downstream from the oblique conveyor 138 and along which the final severance by knife blade 148 takes place.

Figure 14:
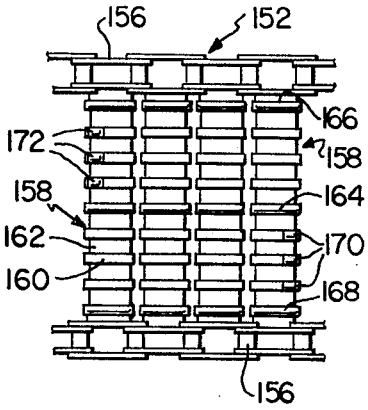
FIG. 14 is a fragmentary, top plan view of the conveyor which loads the short, final lengths of sausages into the cluster-forming turret.

The transfer conveyor 152 includes a pair of laterally spaced, flexible link chains 156 which are bridged by slats 158 of special configuration as illustrated in FIG. 14. There is one slat 158 for each laterally opposed pair of links of the chains 156, and each elongated slat 158 is provided with longitudinally spaced, transversely extending ribs 160 on opposite sides of similarly extending grooves 162. The slats 158 are also provided with centrally disposed, transversely extending partitions 164 and with outwardly projecting, transversely extending, opposite endwalls 166 and 168. Still further, certain of the slats 158 are provided with outwardly projecting drag lugs 170 on one side of the partitions 164 (the sets of lugs 170 being spaced seven slats apart) and, likewise, certain other of the slats 158 are provided with outwardly projecting drag lugs 172 on the opposite side of the partitions 164 (the set of lugs 172 likewise being seven slats apart). The drag lugs 170 are located along the trailing edges of their respective slats 158, while the drag lugs 172 are located along the leading edges of their respective slats 158, and the lugs 170, 172 are so positioned that there is one set of the lugs 172 midway between each pair of sets of lugs 170, and vice versa.

As shown in FIG. 1, the transfer conveyor 152 is looped around four sprockets 174, 176, 178 and 180 in a "forwardly" wrapped manner and is "back-wrapped" around an idler sprocket 182 and a turret 184. Input driving power to the conveyor 152 is supplied through one of the sprockets 174–180, and as will subsequently be seen, the linear speed of the conveyor 152 is slightly greater than the peripheral speed of the turret 184 which is attached to and driven by a shaft 186.

In addition to FIG. 1, the turret 184 is shown principally in detail in FIGS. 7–12, and convenient reference may be had to these figures during further discussion and description of the turret 184 and its associated components. As illustrated in FIG. 10, for example, the opposite chains 156 of the conveyor 152 ride along annular rims 188 of the turret 184, while the slats 158 stretch across and move along the arcuate periphery 190 of the turret 184 between said rims 188.

The turret 184 is also provided with a series of fourteen circumferentially spaced chambers 192 that extend through the turret 184 from one circular face 194 thereof to the opposite circular face 196 thereof. Each chamber 192 is elongated in the direction of the axis of rotation of the turret 184 and, of course, the longitudinal axis of each of the chambers 192 extends in parallel relationship to the drive shaft 186.

The arcuate periphery 190 of the turret 184 is interrupted periodically by inlets 198 to the chambers 192, there being an inlet 198 for each chamber 192, but adjacent chambers 192 having their inlets 198 disposed adjacent opposite ends of the chambers 192. Hence, the effect is to create two adjacent sets of circles of inlets 198 around the periphery 190, each circle having an inlet 198 to every other chamber 192 as the circle is traversed. Stated differently, adjacent inlets 198 as the periphery 190 is traversed circumferentially are spaced axially from one another with respect to the axis of rotation of the turret 184 and are offset circumferentially from one another about the periphery 190.

As shown in FIG. 10, the slats 158 of the conveyor 152 traverse the periphery 190 of the turret 184 and are disposed symmetrically therewith so that the partitions 164 of slats 158 move along the middle of the periphery 190 between the two circles of inlets 198. Hence, one-half of each slat 158 moves along and comes into registration with one circle of the inlets 198, while the other half of each slat 158 moves along and comes into registration with the other circle of inlets 198.

Each of the inlets 198 is provided with an adjacently disposed gate 200 that is mounted for swinging movement about an axis that parallels the longitudinal axis of the corresponding chamber 192. Each of the gates 200 fits within a dished-out socket 202 alongside the corresponding cylinder 192 and is secured to one end of a rod 204 (details in FIG. 11) extending from the socket 202 in the opposite direction completely through the turret 184 and rearwardly beyond the face 194 thereof. A bushing 206 secured to the rear face 194 rotatably receives the rod 204, and a radially extending crank 208 is fixed to the rod 204 just outboard of the bushing 206. At its outermost end the crank 208 carries a cam following roller 210 which, as shown also in FIG. 12, is captured by a cam track 210 in a stationary frame ring 212. The cam track 210 functions to operate the cranks 208 and thereby swing the gates 200 between a closed position covering their respective inlets 198 as illustrated, for example, by the gate **200*a* in FIG. 8, and an opened position represented by the gate 200*b* in that same figure. Each of the cranks 208 has a small cutout 214 as shown in FIG. 12** for clearance purposes during their various swinging movements.

Figure 8:
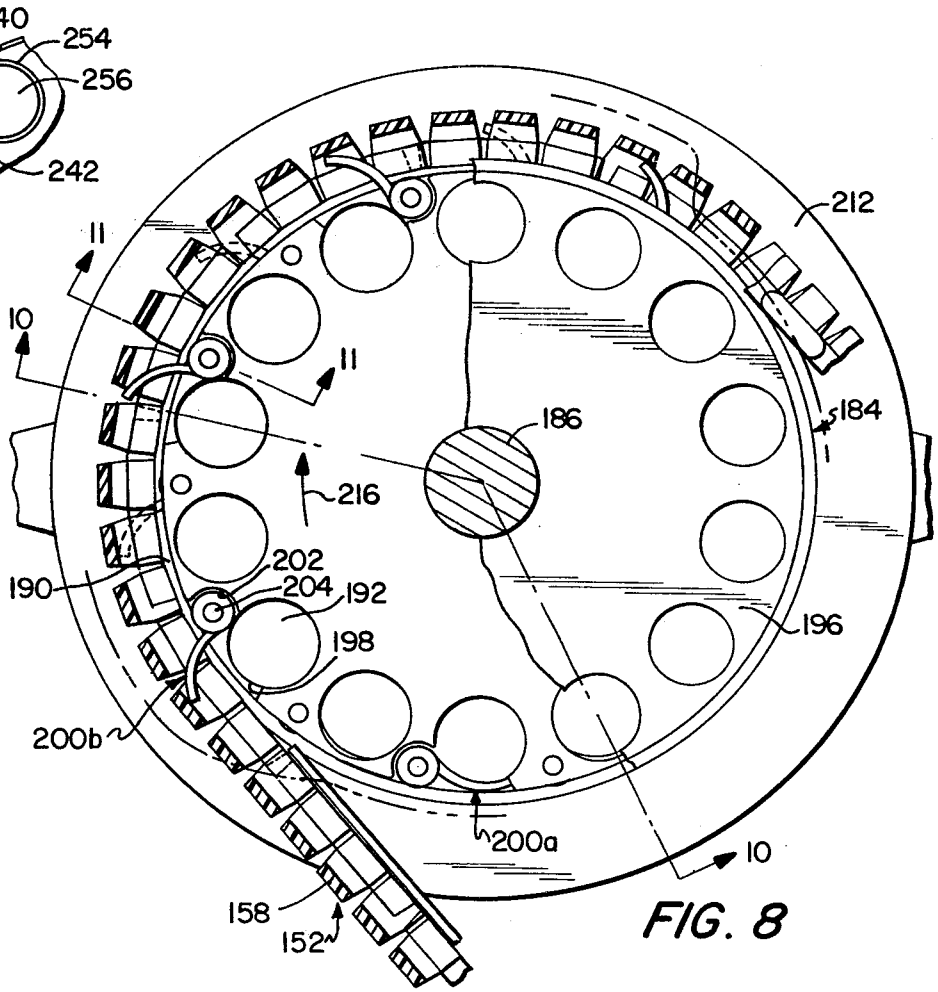
FIG. 8 is an enlarged, fragmentary, transverse, cross-sectional view through the apparatus of FIG. 7 to reveal details of construction.
Figure 9:
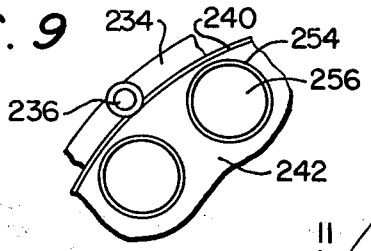
FIG. 9 is a fragmentary, enlarged, detail view showing the way in which rotary components of the apparatus in FIGS. 7 and 8 are supported and guided for such rotation.

Viewing FIG. 8, it will be seen that the turret 184 is adapted for rotation in a clockwise direction as represented by the arrow 216. Each gate 200 is mounted such that its attached end (to the rod 204) leads during rotation of the turret 184 while its free outermost end trails. Each of the gates 200 has a cylindrical boss 218 which receives the corresponding rod 204 and an arcuately extending body 220 that projects substantially tangentially outwardly from the boss 218 with its curvature extending reversely relation to the curvature of the surface of the boss 218. Four fingers 222 project outwardly beyond the body 220 at the same degree of curvature, and such fingers 222 are disposed to slip between the ribs 160 and into the channels 162 of the slats 158 as illustrated in FIG. 10 when the gates 200 are opened and the slats 158 are overlying the same, e.g., the gate **200*b* in FIG. 8**.

The forward face 196 of the turret 184 butts against a spider 224 which is likewise secured to the shaft 186 for rotation therewith at the same speed as the turret 184. The spider 224 has a peripherally disposed series of circumferentially spaced apart notches 226 which are held in fixed registration with respective ones of discharge outlets 228 of the chambers 192 in the turret 184. The discharge outlets 228 are, of course, formed by the open ends of the chambers 192 in the front face 196, and there is provided one notch 226 for each of the outlets 228.

The notches 226 are configured to receive and retain containers such as the container 230 of FIG. 10. The containers 230 are loaded into the spider 224 by mechanism such as that illustrated in FIG. 10 and denoted broadly by the numeral 232. Such mechanism 232 may be of conventional design and thus need not be further described here. Suffice it to point out that the mechanism 232 is adapted to bring the containers 230 in successive order to the spider 224 in a tangential direction and to successively load the notches 226 with the containers 230 in such a manner that open ends of the latter are abutted against the face 196 of turret 184 in receiving registration with the discharge outlets 228.

Figure 7:
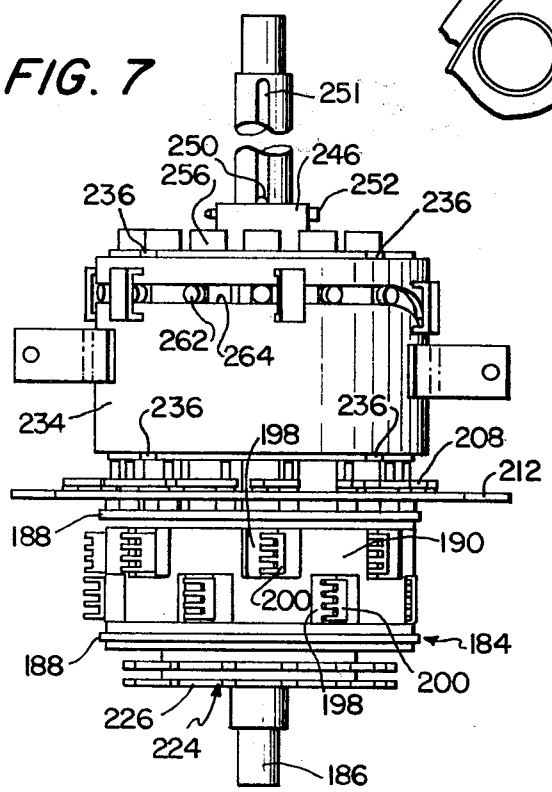
FIG. 7 is a top plan view of that portion of the machine which operates to form clusters of the sausages and to ultimately eject the same into awaiting cans or other containers.

Disposed axially behind the turret 184 and the rear face 194 thereof is a cylindrical housing 234 as shown perhaps best in FIGS. 7 and 10. The housing 234 is fixed to other frame structure not shown and is thus stationary during operation of the machine 10. The housing 234 is disposed concentrically with respect to the drive shaft 186, and the shaft 186 projects rearwardly through and beyond the housing 234. At its opposite annular ends, the housing 234 is provided with a series of circumferentially spaced rollers 236 (detailed in FIG. 9) which serve to confine and guide a composite rotary unit 238 within the interior of the housing 234. Annular tracks 240 are disposed at opposite ends of the unit 238 for the guide rollers 236.

The unit 238 has a pair of circular end plates 242 and 244 respectively having centrally disposed and axially aligned bushings 246 and 248 respectively that receive the shaft 186. The rear bushing 246 is provided with a radially, inwardly projecting key 250 which fits into a mating slot 251 along the shaft 186 so as to prevent relative rotation between the latter and the unit 238 and yet permit the unit 238 to be slid rearwardly along the shaft 186 away from its normal operating position of FIGS. 7 and 10 when a cross pin 252 is removed. The rearwardly shifted position of the unit 238 is not illustrated in the drawings, but suffice it to point out that by shifting the unit 238 rearwardly along the shaft 186, cleaning of the machine 10 is facilitated.

The end plates 242 and 244 of unit 238 are circumferentially perforated so as to receive a series of guide tubes 254 which span the plates 242 and 244 in registration with such perforations. The perforations and guide tubes 254 correspond in number to the chambers 192 of the turret 184 and are maintained in axially registration therewith during operation of the machine 10. Each tube 254 slideably receives a ram 256 having an overall length which exceeds the length of the unit 238 measured axially thereof. Each tube 254 has an axially extending slot 258 (FIG. 10) adjacent the housing 234 which extends from a point slightly inboard of one end of each tube 254 to a termination point slightly inboard of the opposite end of the tube 254. A radial peg 260 projects from each ram 256 adjacent the rear end of the latter and outwardly through and beyond the corresponding slot 258 to carry a roller 262 for rotation about an axis transverse to the ram 256. The rollers 262, in turn, are captured within a cam track 264 which circumscribes the housing 234 and is disposed to reciprocate the rams 256 between the fully retracted position of the ram **256*a* in FIG. 10 and the fully extended position of the ram 256*b* in FIG. 10. Note that in the retracted position of the ram 256*a*, the leading end of the latter is inserted slightly into the aligned chamber 192, while in the position of the ram 256*b*, the latter is fully projected through the chamber 192 and slightly into the registered notch 226 of the spider 224**.

OPERATION

As distinguished from prior U.S. Pat. No. 2,864,216 wherein the initial long sausage pencils are grouped together into clusters and then severed to length while within the cluster and prior to packing the severed lengths into cans, the present invention contemplates initially severing the long sausage pencils into proper lengths, then grouping the same into clusters, and thereupon packing the same into their awaiting cans. This, however, requires substantial reorientation and arrangement of the various sausage lengths as they are prepared for packing, and such will now be described in detail.

Figure 16:
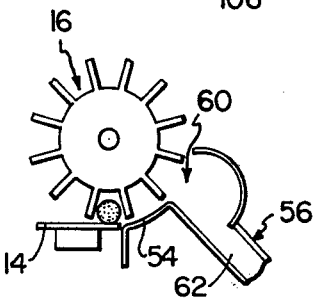
Figure 17:
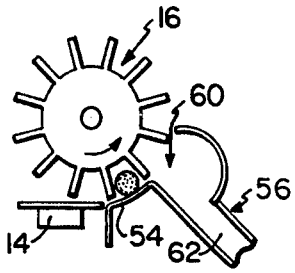

Long sausage pencils having their casings removed by the peeler 12 are placed in single file order and are moved along the product conveyor 14 into the machine 10 as illustrated schematically in FIG. 15. Each incoming pencil moves beneath the indexing cylinder 16 and between a pair of the flutes 58 thereof until the leading end of the pencil engages and depresses the arm 22 so that the latter swings rearwardly about the pivot 24 and depresses the microswitch 26 shown in FIG. 3. This has the effect of activating the drive assembly 28 in the manner earlier explained so that, with the pencil positioned as illustrated in FIG. 16, the indexing wheel 16 is rotated through one counter-clockwise increment of travel to the position illustrated in FIG. 17, placing the pencil onto the shelf 54.

Figure 18:
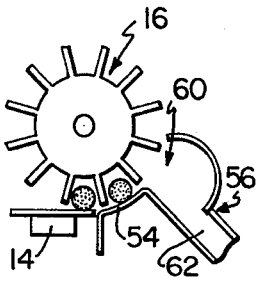
Figure 19:
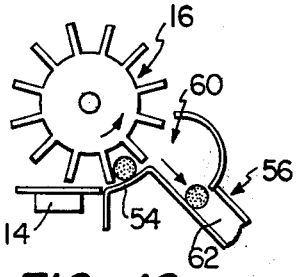
Figure 20:
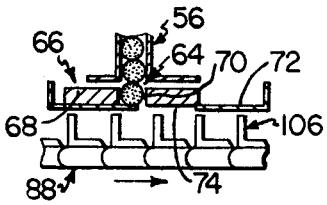

When the next sausage pencil is moved by the conveyor 14 against the deflectable arm 222 so that the drive assembly 28 is again activated, the two pencils are indexed by the cylinder 16 from their positions of FIG. 18 to the positions of FIG. 19, whereupon the leading pencil enters the mouth 60 of magazine 56 and gravitates through the passage 62 toward the discharge exit 64 thereof. Upon reaching the exit 64, the pencil joins other prior pencils in a stack as illustrated in FIG. 20.

The escapement assembly 66 and the conveyor 88 are so timed that a pencil is deposited onto the conveyor 88 as every sixth carrier 106 passes the opening 74 in deck 72. See, for example, FIG. 22, wherein the sausage pencils loaded onto the conveyor 88 are six carriers apart. As shown in FIG. 20, the shuttle plate 68 of escapement assembly 66 when in its rearmost position receives the lowermost pencil from the magazine 56 into slot 70. As the shuttle plate 68 then moves forwardly as shown in FIG. 21, the pencil carried within the slot 70 becomes registered with the opening 74 in the deck 72, permitting the pencil to drop downwardly into the awaiting carrier 106. Thereupon, the shuttle plate 68 returns as shown in FIG. 22, and it is to be noted that the plate is operable to keep the next sausage pencil from dropping into the slot 70 until the plate 68 is fully returned to its loading position of FIG. 20.

Figure 22:
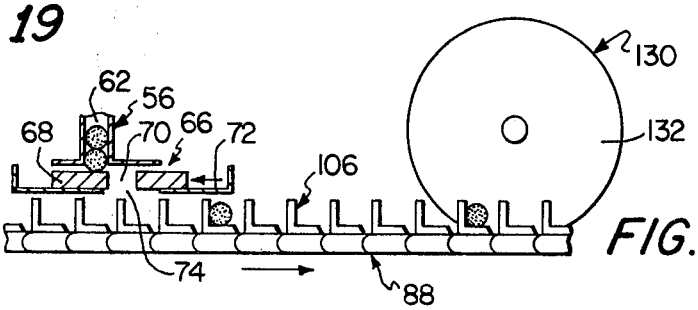

FIGS. 22 and 23 show a pair of sausage pencils that have been deposited onto the conveyor 88 by the escapement assembly 66. As the pencils approach the staggered end of the conveyor 88 as shown in FIG. 23, the leading pencil is cut into six, separate segments a, b, c, d, e and f by the cutters 130, plus two scrap ends on the outboard side of the endmost cutting discs 132. As shown, the scrap ends are carried by the endmost conveyor subsections **94*b* and 104*a*, while the segments a–f are carried by respective ones of the conveyor segments 94–104. Note further that along this stretch of the conveyor 88, all six of the segments a–f are aligned end-to-end in a line that extends perpendicular to the path of travel of the conveyor 88**.

As the leading sausage pencil of FIG. 23 is severed into segments a–f, such segments come beneath the wrapper strips 136 so as to remain fully contained within their respective carriers 106 during movement around the staggered end of the conveyor 88. As a result of the special staggered nature of this end of the conveyor 88, the segments a–f are displaced laterally with respect to one another and become oriented into a diagonally extending line across the conveyor 88 as illustrated in FIG. 25. At this time, along the downstream stretch of the conveyor 88 with respect to the sprockets 114, the segments a–f become supported from beneath by underlying portions of the wrapper strips 136, while the scrap ends are dropped for further processing elsewhere.

As the segments a–f continue to move leftwardly viewing FIG. 25 along the lower stretch of the conveyor 88, they progressively leave the underlying support of the wrapper strips 136 and become supported instead by the upper surface of the obliquely moving belt 140 of gathering conveyor 138. Because the belt 140 has a velocity component in the direction of movement of the conveyor 88 that is equal to the speed of conveyor 88, the belt 140 has no "forward" movement relative to the conveyor 88. Thus, the segments a–f are not shifted in a forward direction relative to the conveyor 88, but the component of travel of the belt 140 in a lateral direction toward the barrier 146 has the effect of shifting the segments a–f across the conveyor 88 and out of their diagonal line into a line that parallels the path of travel of the conveyor 88 as shown in FIG. 25. The barrier 146 operates to block lateral movement of the segments a–f beyond the conveyor section 104, and it is thus within the carriers 106 of the section 104 that the segment a–f ultimately come to rest.

If desired, the line of side-by-side segments carried by the section 104 may then be fed directly into apparatus for grouping the segments into clusters and then packing the same into awaiting containers. This, of course, is within the principles of the present invention.

However, ideally, and when dealing with Vienna Sausages, it is normally necessary to subdivide the segments into still shorter lengths or parts, and this may be accomplished as illustrated in FIG. 25 by the knife blade 148 which passes down the center of the section 104 and partially into the gap between the subsections **104*a* and 104*b* thereof. Hence, the segments of the section 104 each become divided into a pair of spaced apart, end-to-end parts, and two separate, side-by-side lines of such parts are discharged onto the transfer conveyor 152 at the receiving end of the latter below the floor 154**.

The transfer conveyor 152 moves at the same linear speed as the conveyor 88, and the timing is such that seven of the sausage parts (hereafter "sausages") are deposited into each half of the conveyor 152 between each pair of the drag lugs 170 or 172. Hence, the conveyor 152 becomes loaded with side-by-side groups of seven sausages each, and the groups on opposite sides of the separating partitions 164 down the middle of the conveyor 152 are longitudinally offset from one another in accordance with the offset relationship of the lugs 170 and 172.

As illustrated in FIG. 26, after the conveyor 152 was moved around the idling sprocket 162, it is inclined upwardly against the force of gravity, thus causing each group of sausages to roll back against the respective drag lugs 170 or 172. Keeping in mind that the gates 200 which control the inlets 198 of the chambers 192 on turret 184 are themselves controlled by the operating cranks 208 and cam track 210 (FIG. 12), the gates 200 are closed just prior to the point of tangential engagement of the conveyor 152 with the turret 184 along the incoming stretch of the conveyor 152. This is represented by the gate 200' in FIG. 26. By the time the gate 200' and its chamber 192' have advanced to the position of FIG. 27, the gate 200' has been opened, and the drag lug 170 or 172 of the conveyor 152 has just passed. At this time the fingers 272 of the gate 200' fit into the grooves 162 of the conveyor slats 158.

FIGS. 26–32 illustrate the manner in which the conveyor 152 deposits the sausages into the chambers 192, and it will be appreciated from viewing these figures that such procedure is illustrated with respect to only one-half of the conveyor 152, that is, with respect to the sausages on one side of the partitions 164. Precisely the same type of procedure is being followed with respect to the other line of sausages, although, timewise, the steps are carried out in an offset or slightly delayed manner because, it will be remembered, the sausage groups on opposite sides of the partitions 164 are longitudinally offset from one another. Thus, it is to be understood that while the sausages illustrated in FIG. 27 approach the gate 200' and the chamber 192', the sausages to be loaded into the next chamber 192'' will come from those sausages lying on the opposite side of the partitions 164.

Because the conveyor 152 moves at a greater linear speed than the peripheral speed of the turret 184, the sausages coming into engagement with the periphery 190 of the turret 184 are moved along the latter by the conveyor 152. See, for example, FIG. 27 wherein the sausage group approaches the periphery 190 and FIG. 28 where the sausage group has advanced along the periphery 190 until the leading sausage is just entering the inlet 198'. Sausages trailing the leading sausage are, of course, fully supported by the periphery 190 and, by the time the chamber 192' reaches the position of FIG. 29, the conveyor 152 will have advanced enough relative to the turret 184 to have deposited four of the sausages into the chamber 192. By the time the chamber 192' reaches the position of FIG. 30, all seven of the sausages will be deposited into the chamber 192, thus forming a cluster thereof.

As the chamber 192' reaches the position of FIG. 31, the gate 200' is swung closed so as to retain the cluster of sausages in place during the downside rotation of the turret 184. Note at this point also that the conveyor 152 departs tangentially from the turret 184 so that any retentive effect heretofore available from the conveyor 152 is terminated.

Between the positions of FIG. 31 and FIG. 32, the ram 256 of the chamber 192' is operated by interaction of its cam follower 262 and the cam track 264 such as to begin moving toward its full stroke position represented by the ram **256*b* in FIG. 10. At this time also, the spider 224 has received a container 230 and has aligned the same with the discharge outlet 228 of the chamber 192' so that, as the ram 256 moves through the chamber 192' axially, the sausage cluster is progressively rammed into the awaiting container 230 until, as represented by FIG. 32, the ram 256 is at full stroke and the sausage cluster is fully within the container 230. Thereupon, the packed container 230 leaves the spider 224 via the mechanism 232 for subsequent further processing, and the turret 184** approaches its complete 360° of revolution to repeat the above procedure.

We claim:

1. In a machine for packing clusters of side-by-side sausages into containers wherein the individual sausages are obtained from initial sausage pencils having lengths several times greater than the length of each sausage, the improvement comprising:

means for severing end-to-end segments from each pencil, collecting the end-to-end segments into side-by-side relationship, and grouping side-by-side segments into clusters so that at least several of the segments in each cluster are obtained from the same pencil, said means including mechanism for processing the pencils into a line of side-by-side segments and apparatus for receiving the line of segments from the mechanism and for grouping the same into multi-segment clusters having generally cylindrical configurations, said apparatus including a turret having a series of cylindrical, cluster-maintaining chambers and transfer structure for receiving side-by-side segments from said mechanism and depositing the same by groups into said chambers, thereby forming said clusters, said turret being rotatable about a certain axis and being provided with an arcuate periphery, said chambers having longitudinal axes that extend in parallel relationship to said axis of rotation of the turret and being spaced apart in a circumferential series about said axis of rotation, said chambers each being provided with a transverse inlet from said periphery rendering the latter discontinuous, said transfer structure including an endless, flexible conveying element looped around said periphery of the turret and operable to move segments along the periphery and into said inlets as the elements and the turret are driven at relatively differing speeds.

2. In a machine as claimed in claim 1; and means for subdividing each segment into multiple parts prior to packing.

3. In a machine as claimed in claim 2; and means for placing the parts of each segment into different containers.

4. In a machine as claimed in claim 1, wherein said mechanism includes:

a conveyor operable to receive pencils at spaced intervals and to advance the same in a direction transverse to their respective longitudinal axes;

a series of cutters spaced across said conveyor for effecting said severing of each pencil into end-to-end segments, said conveyor including a plurality of separate, endless, side-by-side sections, each disposed to carry one of said segments after severance on the upstream side of one end of the conveyor, said sections being staggered across said one end of the conveyor and being of progressively increasing length as said one end of the conveyor is traversed, thereby causing the segments of each pencil to displace laterally relative to one another as the conveyor sections move around said one end of the conveyor, said sections being of such lengths, relative to one another, that, upon reaching the downstream side of said one end of the conveyor, the segments of a pencil are arranged diagonally across the conveyor in laterally offset relationship to one another; and means along the downstream side of said one end of the conveyor for gathering the diagonally disposed segments axially onto one of said sections and into said line in side-by-side relationship to one another.

5. In a machine as claimed in claim 4, wherein said gathering means for diagonally disposed segments includes a device engageable with the diagonally disposed segments and movable in an oblique direction relative to the path of travel of said sections on the downstream side of said one end of the conveyor, said device having a velocity component in the direction of said path of travel that is substantially equal to the linear speed of said sections, said device having a velocity component in the transverse direction relative to said sections and toward said one section that is sufficient to effect said gathering of the diagonally disposed segments onto said one section.

6. In a machine as claimed in claim 5, wherein said conveyor is so disposed that said sections are presented for underlying the segments along said upstream side of said one end of the conveyor and for overlying the segments along said downstream side of said one end of the conveyor, said device having an upwardly facing, segment-engaging surface.

7. In a machine as claimed in claim 1, wherein said element is driven at such a linear speed greater than the peripheral speed of the turret that the segments for each cluster are all successively deposited into the corresponding chamber during a single revolution of said turret.

8. In a machine as claimed in claim 7, wherein each of said chambers has an open end; and means operably associated with said member for ramming the clusters axially out of the open ends of said chambers and into awaiting containers as the cluster-filled chambers move past a certain point in each revolution of the turret.

9. Article handling means comprising:

a conveyor adapted to move a group of articles along a predetermined path of travel while the articles are spaced apart across and along the conveyor; and a gathering device operably associated with said conveyor in disposition for engaging the articles of the group and shifting the same to a common lateral side of the conveyor without diminishing the speed of the articles in the direction of said path of travel or changing their order of appearance along the conveyor, said device including a second conveyor disposed across said first-mentioned conveyor in oblique relationship to said path of travel, said second conveyor having a velocity component in said direction of said path of travel that is substantially equal to the speed of said first-mentioned conveyor, said second conveyor having a velocity component toward said common lateral side of the conveyor that is sufficient to effect said shifting, said first-mentioned conveyor being provided with a downwardly facing surface disposed to overlie said articles during said shifting thereof by said second conveyor, said second conveyor having an upwardly facing surface disposed to underlie said articles during said shifting thereof.

10. Article handling means comprising:

a conveyor adapted to move a group of articles along a predetermined path of travel while the articles are spaced apart across and along the conveyor; and a gathering device operably associated with said conveyor in disposition for engaging the articles of the group and shifting the same to a common lateral side of the conveyor without diminishing the speed of the articles in the direction of said path of travel or changing their order of appearance along the conveyor, said conveyor having one stretch thereof adapted to handle said group of articles when the same are spaced apart along the conveyor, said conveyor having a second stretch, upstream from said one stretch, adapted to handle said group of articles when the latter are aligned across the conveyor in perpendicular relationship to the path of travel of the conveyor; and means between said second and first stretches for displacing the articles out of said alignment and into said spaced relationship along the conveyor.

11. Article handling means as claimed in claim 10, wherein said conveyor includes a plurality of separate, endless, side-by-side sections moving in parallel relationship with one another and each adapted, along said second conveyor stretch, to handle one of the aligned articles of the group, said conveyor further including a plurality of individual guides about which respective ones of said sections are looped so as to dispose said second and first stretches on opposite upstream and downstream sides respectively of the guides, said displacing means including an assembly for disposing said guides in staggered relationship to one another and said sections being of progressively increasing length as the conveyor is traversed from said common lateral side of the conveyor to the opposite lateral side thereof, thereby causing the aligned articles of the group to effect said displacement as they move around said guides.

12. Article handling means as claimed in claim 11; a feeder operable to intermittently supply said second stretch upstream of said guides with a group of the articles integrally interconnected for transverse movement by the conveyor, said connected articles spanning all sections of the conveyor along said second stretch; and means for separating the articles from one another upstream from said guides.

13. Article handling means as claimed in claim 11, wherein said assembly includes a fluid pressure manifold having a series of intercommunicated fluid-pressure cylinders, said assembly further including a ram in each of said cylinders respectively and extendible therefrom by said fluid pressure, said guides being mounted on respective ones of said rams and the latter being of progressively increasing lengths according to lengths of their respective sections whereby to effect said staggered relationship of the guides to one another.

14. Article handling means comprising:

a plurality of endless, flexible conveyor sections extending in parallel relationship to one another;

guides for said sections at opposite ends of the latter, there being one guide for each of said sections respectively at one end of the latter and said sections being looped around respective ones of said guides at said one end;

means for driving said sections in unison about said guides such that each of the sections presents a stretch upstream from its guide at said one end of the sections and a stretch downstream from its guide at said one end of the sections, said upstream stretches being adapted to move a transversely extending line of separate articles, with one article on each section, toward said one end of the sections, said sections being of progressively increased length as the sections are traversed from one lateralmost section to the opposite lateralmost section;

means for maintaining said guides at said one end of the sections in staggered relationship to one another according to the lengths of their respective sections so that, as the articles are moved around said guides by the sections, the articles are displaced out of said transverse line toward a diagonally extending line along said downstream stretch; and means for retaining the articles on said sections as the latter move around their respective guides at said one end of the sections and along said downstream stretch.

15. Article handling means as claimed in claim 14; and means along said downstream stretches of the sections in disposition to engage the diagonally disposed articles and shift the same to said one lateralmost section into a line parallel to the path of travel of said downstream stretches.

16. Article handling apparatus comprising:

a turret having an arcuate periphery and at least one chamber provided with an inlet thereto from said periphery;

an endless, flexible conveyor looped around said periphery and adapted to confine a series of articles along and between the loop of the conveyor and said periphery; and means for driving said conveyor and said member at a predetermined speed differential so that articles between the conveyor and the periphery of the member are caused to move progressively along said periphery and successively into said chamber through its inlet so as to form a cluster of the articles within the chamber.

17. Article handling apparatus as claimed in claim 16, wherein the peripheral speed of said member is less than the linear speed of said conveyor.

18. Article handling apparatus as claimed in claim 17, wherein said chamber is provided with an outlet disposed at right angles to said inlet; and means for ejecting said cluster of articles from the chamber through said outlet for reception by an awaiting container.

19. Article handling apparatus as claimed in claim 16; a shiftable gate at said inlet for controlling the latter; and means for operating said gate in timed relation to rotation of the turret to open the gate during deposit of the articles into the chamber and to close the gate following said deposit.

20. Article handling apparatus as claimed in claim 16; and at least a single second chamber in said turret having its own inlet from said periphery, said inlets for the two chambers being spaced apart axially and being offset circumferentially of one another, said conveyor being adapted to simultaneously move two separate circumferentially offset and axially spaced series of articles along said periphery in registration with corresponding ones of said chambers for accumulating the articles into clusters within their respective chambers.

21. Article handling apparatus as claimed in claim 20, wherein the peripheral speed of said member is less than the linear speed of said conveyor.

22. Article handling apparatus as claimed in claim 21, wherein said chambers are provided with outlets disposed at right angles to their respective inlets; and means for ejecting said clusters of articles from their respective chambers through said outlets as the chambers move past certain points in their revolution with the turret.

* * * * *